US009913776B1

(12) United States Patent
Tang et al.

(10) Patent No.: US 9,913,776 B1
(45) **Date of Patent: *Mar. 13, 2018**

(54) ENHANCED CHEST COMPRESSOR

(71) Applicant: Weil Institute of Critical Care Medicine, Rancho Mirage, CA (US)

(72) Inventors: Wanchun Tang, Palm Desert, CA (US); Max Harry Weil; Joe Bisera; Carlos Castillo, Cathedral City, CA (US)

(73) Assignee: SUNLIFE SCIENCE INC., Shanghai (CN)

( * ) Notice: Subject to any disclaimer, the term of this patent is extended or adjusted under 35 U.S.C. 154(b) by 726 days.

This patent is subject to a terminal disclaimer.

(21) Appl. No.: 14/444,784

(22) Filed: Jul. 28, 2014

Related U.S. Application Data

(63) Continuation of application No. 11/804,558, filed on May 18, 2007, now Pat. No. 8,790,285.

(51) Int. Cl.
*A61H 31/00* (2006.01)

(52) U.S. Cl.
CPC ..... *A61H 31/00* (2013.01); *A61H 31/006* (2013.01); *A61H 2201/1246* (2013.01)

(58) Field of Classification Search
CPC .... A61H 31/00; A61H 31/004; A61H 31/005; A61H 31/006; A61H 31/008; A61H 2201/1246
USPC ..... 601/106–108
See application file for complete search history.

(56) References Cited

U.S. PATENT DOCUMENTS 2,486,667 A 11/1949 Meister
2,970,592 A * 2/1961 David ..... A61H 1/008 601/107
3,289,672 A 12/1966 Thomas
3,307,541 A 3/1967 Hewson
3,396,721 A 8/1968 Menacci
3,511,275 A 5/1970 Hewson
(Continued)

*Primary Examiner* — Justine Yu
*Assistant Examiner* — Christopher Miller
(74) *Attorney, Agent, or Firm* — Lawrence S. Cohen

(57) ABSTRACT

A chest compressor includes a piston (14) that moves in downward and upward strokes within a cylinder (12), with the piston undergoing a smooth reversal at the bottom of the downward stroke. A compression spring, such as a wave spring (60), is positioned to engage the piston only near the end of its downward stroke, to smoothly reverse the piston motion, limit downward force on the patient at the end of the stroke, and avoid a downward pulse due to the momentum of the downwardly-moving piston. A stop (90, 92) is latchable in an inward position to allow reduction in the piston stroke by engaging an outward flange (52) on the piston before the piston has moved fully downward. In one embodiment the piston (14) is made as an outer piston part (40) and an inner piston part (42) that telescope in one another in which the outer piston part is slidably engaged with and guided by the cylinder along a path and the inner piston part is slidably engaged with and guided by the outer piston part and the spring (60) engages the inner piston part near the end of its downward stroke, to smoothly reverse the piston motion, limit downward force on the patient at the end of the stroke, and avoid a downward pulse due to the momentum of the downwardly-moving piston.

12 Claims, 3 Drawing Sheets

(56) References Cited

U.S. PATENT DOCUMENTS 3,512,522 A * 5/1970 Greenlee ..... A61H 31/006 601/106
3,610,233 A 10/1971 Barkalow
3,955,563 A * 5/1976 Maione ..... A61H 23/04 601/106
3,965,893 A * 6/1976 Ragailler ..... A61H 31/00 601/106
3,978,854 A 9/1976 Mills, Jr.
4,059,099 A * 11/1977 Davis ..... A61H 31/00 601/107
4,088,128 A 5/1978 Mabuchi
4,361,140 A 11/1982 Barkalow
4,495,940 A * 1/1985 Takaishi ..... A61H 23/00 54/48
4,512,339 A 4/1985 McShirley
4,549,535 A 10/1985 Wing
4,554,910 A 11/1985 Lally
4,570,615 A 2/1986 Barkalow
4,602,728 A 7/1986 Ha
4,624,382 A 11/1986 Tontarelli
4,664,098 A 5/1987 Woudenberg
4,669,454 A 6/1987 Shamos
4,702,231 A 10/1987 Arpin
4,770,164 A 9/1988 Lach et al.
4,915,095 A 4/1990 Chun
5,327,887 A * 7/1994 Nowakowski ..... A61H 31/006 128/202.13
5,399,148 A 3/1995 Waide et al.
5,639,074 A * 6/1997 Greenhill ..... F16F 1/328 267/158
5,660,182 A 8/1997 Kuroshaki et al.
5,738,637 A 4/1998 Kelly et al.
5,743,864 A 4/1998 Baldwin, II
5,860,706 A 1/1999 Fausel
5,936,765 A 8/1999 Walsh
6,056,164 A 5/2000 Wakayama
6,066,106 A 5/2000 Sherman et al.
6,090,056 A 7/2000 Bystrom et al.
6,129,005 A 10/2000 Asadi et al.
6,224,562 B1 * 5/2001 Lurie ..... A61H 31/00 601/41
6,790,184 B2 * 9/2004 Thierman ..... A61B 9/00 600/553
6,976,969 B2 12/2005 Messerly
7,060,041 B1 * 6/2006 Weil ..... A61H 31/00 601/106
7,104,967 B2 9/2006 Rothman et al.
7,846,112 B2 12/2010 Escudero et al.
8,491,507 B2 7/2013 Tang et al.
8,790,285 B2 7/2014 Bisera et al.
2004/0030272 A1 2/2004 Kelly et al.
2005/0015026 A1 * 1/2005 Well ..... A61H 31/006 601/44
2005/0148909 A1 * 7/2005 Weil ..... A61H 31/004 601/41
2005/0183911 A1 * 8/2005 Wilda ..... F16F 9/3485 188/322.15
2006/0099559 A1 * 5/2006 Kohl ..... A61H 31/007 434/265
2007/0150004 A1 6/2007 Colloca et al.
2008/0287863 A1 * 11/2008 Bisera ..... A61H 31/00 604/44

* cited by examiner

ENHANCED CHEST COMPRESSOR

CROSS-REFERENCE TO RELATED APPLICATION

This is a continuation of U.S. Utility patent application Ser. No. 11/804,558, filed on May 18, 2007, now U.S. Pat. No. 8,790,285, issued on Jul. 29, 2014, which is incorporated herein by reference.

BACKGROUND OF THE INVENTION

An automatic chess compressor can be carried by an emergency worker and applied to a patient to stimulate blood circulation and breathing. Such a chest compressor usually includes a piston that moves up and down in a cylinder (assuming that the patient is reclined so his chest faces upward). The cylinder is held closely over the patient's chest as by a strap wrapped around the patient's chest area. The chest compressions may occur at a frequency such as ½ to one second apart, so the piston moves downward rapidly in each stroke.

A rapidly downwardly-moving piston tends to impart a downward pulse to the patient at the bottom of the stroke, which is not desirable. It is possible to use a spring that is fixed to the piston to reduce the downward force as the piston moves down. However, the spring force applied along most of the piston movement tends to slow piston movement so additional energy is required to move the piston. A spring has the advantage of more rapidly raising the piston after each chest compression, but it is found that resilience of the chest is sufficient to rapidly raise the piston after each downward stroke.

In most cases, the patient's chest should be compressed by about one to two inches in each stroke, to benefit blood circulation and breathing while avoiding harm to the patient's chest (e.g. by breaking a rib). The piston actually must apply a downward stroke of about two to four inches to produce a patient chest compression of about one to two inches because the backup such as the strap wrapped about the patient, presses into the patient and takes up some of the compression. For children and small adults, it is desirable to reduce the chest compression to near the minimum, while for adults of normal to large size it is desirable to use chest compressions close to the maximum. The chest compressor should be easily and rapidly convertible between different compression distances.

SUMMARY OF THE INVENTION

In accordance with one embodiment of the present invention, a chest compressor is provided of the type that comprises an actuator that includes a piston that moves vertically (when the patient's chest faces upward) to repeatedly compress the patient's chest, in a downstroke, wherein piston motion is gradually reversed, to an upstroke, near the bottom of its downstroke, while minimizing the energy absorbed to create such reversal. The piston moves during most of its downstroke without having to overcome the force of a spring that would slow its downward motion. A spring, such as a wave spring, first engages the piston near the bottom of its downstroke and at that time the spring rapidly slows downward motion of the piston and avoids a large downward force at the end of the stroke. Compressed fluid is provided to apply pressure to the piston causing the downstroke and the upstroke is allowed by releasing the pressure of the compressed fluid. In this way. the piston is repeatedly moved from an upward position to a downward position against the chest of the patient.

The length of piston stroke is easily varied by the emergency worker, so the stroke length can be changed for different patients. This is accomplished by providing one or more stops that can be moved into the path of the piston. In a telescoping piston arrangement wherein an inner piston part lies within an outer piston part, the stop(s) engage only the outer piston part. The compression spring that reverses piston movement, lies at the bottom of the outer piston part to engage an outward flange at the top of the inner piston part near the end of the piston down stroke.

The novel features of the invention are set forth with particularity in the appended claims. The invention will be best understood from the following description when read in conjunction with the accompanying drawings.

DETAILED DESCRIPTION OF THE INVENTION

Figure 1:
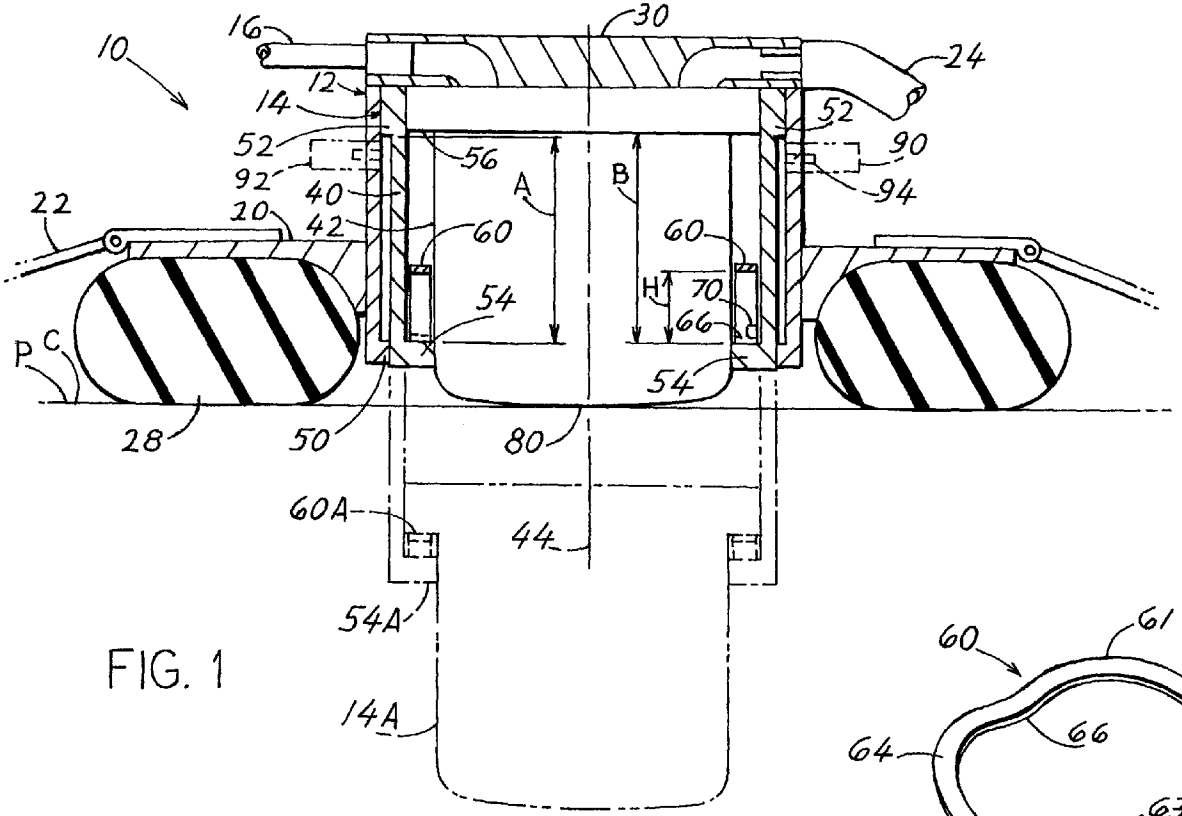
FIG. 1 is a sectional view of a chest compressor of the present invention showing stops in phantom lines.

FIG. 1 illustrates a chest compressor 10 mounted on a patient P to repeatedly compress the patient's chest C. The chest compressor includes a cylinder 12 (which is not necessarily cylindrical) whose function is to guide a piston 14 in vertical movement. In the following discussion it is assumed that the patient lies in a reclined position with his/her chest facing upward. A frame 20 is attached to the cylinder and it holds a strap 22 that encircles the patient's upper torso and holds a stabilizer 28 that resists tipping. The piston 14 repeatedly moves from an upward position shown at 14 to a downward position shown at 14A, at a rate such as a stroke every ½ to one second.

In the chest compressor illustrated, the piston 14 is moved downward by compressed fluid such as compressed air or oxygen that flows through a control into the cylinder 12 through a tube 24 and out through another tube 16, both tubes being connected to a top plate 30 of the cylinder. Applicant finds that sufficiently rapid upward movement is produced by the resilience of the patient. Means other than compressed gas can be used to move the piston up and down, including an electrically powered mover such as a solenoid or motor(s).

The piston illustrated in FIG. 1 is a telescoping piston which includes a plurality of piston parts that lie one within the other, with first and second, or outer and inner piston parts 40, 42 being shown. The piston has an axis 44. The cylinder has a radially inwardly-projecting (with respect to the axis 44) flange 50 at its bottom. The outer piston part 40 has top and bottom flanges 52, 54, and the inner piston part 42 has a top flange 56. When the piston reaches nearly its lowest position at 14A, the inner piston flange 56 approaches the outer piston part lower flange at 54A. If there were no spring to slow the downward movement of the inner piston part near the end of the downward stroke, the downward momentum of the inner piston part would result in an extra downward pulse applied to the patient, which might injure the patient without increasing blood circulation or breathing.

Figure 2:
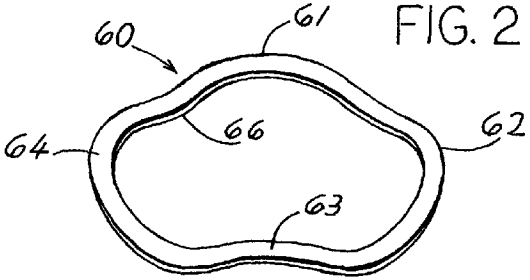
FIG. 2 is an isometric view of a wave spring of the chest compressor of FIG. 1.

In accordance with one aspect of the invention, applicant positions a compression spring 60, in the form of a wave spring, in the path of the inner piston part 42. The wave spring 42 shown in FIG. 2, has four raised parts 61-64 and four corresponding lower parts 66 between the raised parts. The wave spring 42 has opposite sides, a horizontal width measured between the opposite sides, and a vertical height less than the horizontal width. FIG. 1 shows that the spring lower parts 66 rest on the bottom flange 54 of the outer piston part and the spring is preferably held there against movement as by adhesive or by a hold down pin 70. The adhesive or the hold down pin 10 holding the compression spring on the outer piston part bottom flange. Although the wave spring is of small radial width, the bottom flange 54 of the outer piston part is provided with a larger radial width than the cylinder bottom flange, to hold the wave spring.

In normal operation, the outer piston part 40 moves downward until its top flange 52 is stopped by the cylinder flange 50, and the inner piston part has begun to move down within the outer piston part. This is done by causing the compressed fluid to apply pressure to the piston to cause the downstroke and to allow the upstroke by releasing the pressure. The inner piston part top flange 56 engages the wave spring 60 and compresses it against the outer piston part bottom flange 54. Such compression of the wave spring as to 60A, slows downward movement of the inner piston part to avoid a large force at the end of piston downward movement, and even helps reverse the piston direction of motion. In the prior art, springs were provided that were continuously connected to the piston to continually urge it upward. As a result, greater energy (e.g. higher pressure air) was required to rapidly move the piston in a full downward stroke. In the present invention, the compression spring engages the piston to slow its downward movement only near the end of downward piston movement, so energy is absorbed from the piston only along a small portion of its stroke.

Figure 1A:
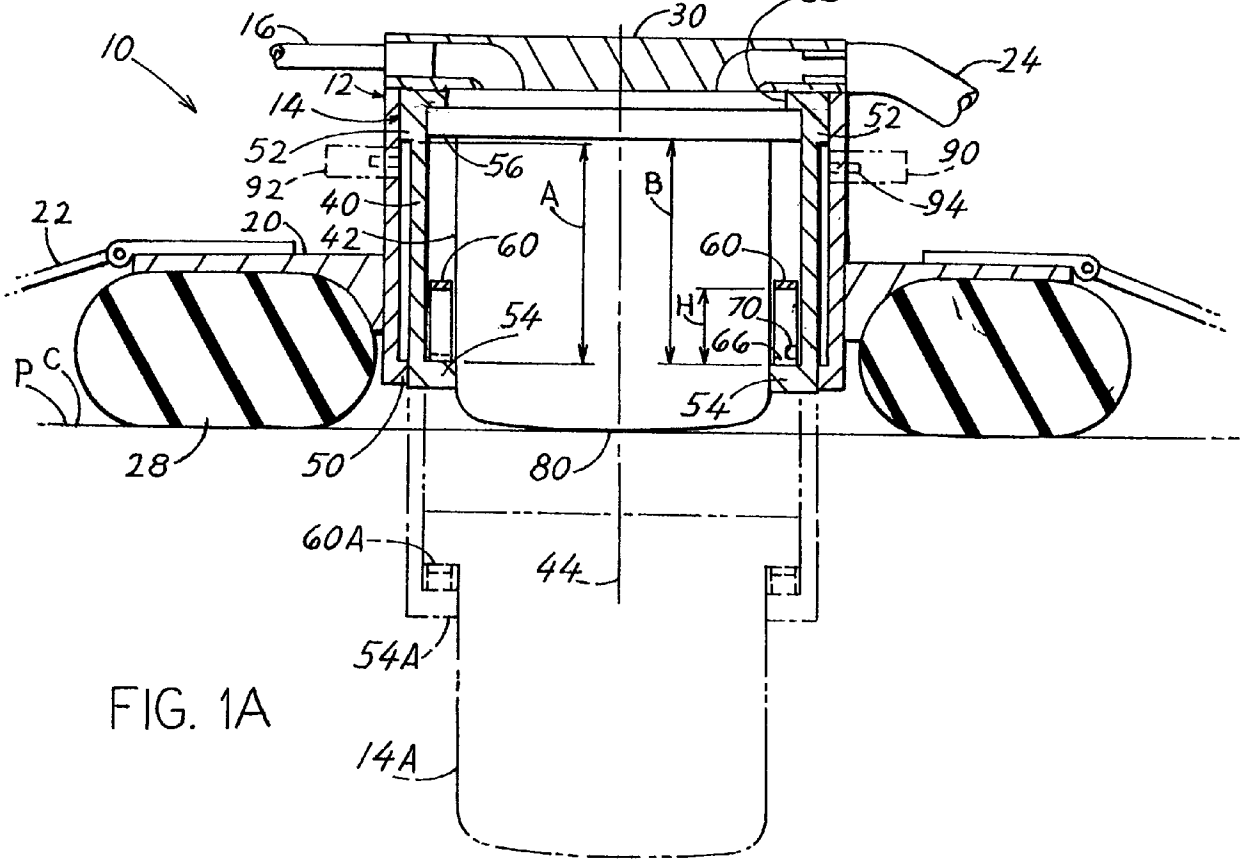
FIG. 1A is a sectional view similar to FIG. 1 but showing that the outer piston part 40 has a flange 55 so that the inner piston part 42 always lies below the top of the outer piston part.

FIG. 1 shows that the outer piston part has a stroke length A between its upward position and a position where its top outer flange 52 is stopped by the cylinder flange 50. The inner piston part has a maximum stroke length B between its top flange 56 lying against the top plate and its top flange 56 fully compressing the wave spring against the outer piston part flange 54. As shown in FIG. 1A, the outer piston part 40 can be provided with an internal flange 55 to assure that the inner piston part 42 always lies below the top of the outer piston part 40. The lengths A and B are each about two inches, and the distance A+B is about four inches. The wave spring has an uncompressed height H that is about 20 millimeters (about 0.8 inch). Therefore, the wave spring does not engage and begin slowing the inner piston part top flange 56 until the outer piston part has moved down completely (about 2.0 inches) and the inner piston part has moved down along a partial stroke length (2 inches−0.8 inch=1.2 inch) so the complete piston has moved down 3.2 inches out of a maximum stroke length of 4.0 inch.

Figure 3:
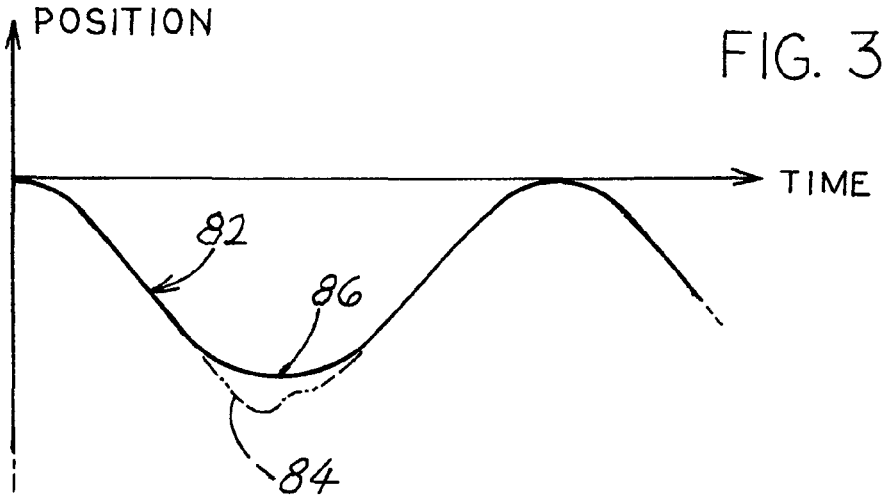
FIG. 3 is a graph showing an idealized path of a piston of the invention, and showing how the momentum of the piston could produce a pulse in the absence of the spring of the present invention.

FIG. 3 is an idealized graph 82 of motion of the bottom 80 of the piston, with the piston moving down and up about every one-half to one second. Without the wave spring, the momentum of the rapidly moving piston inner part would produce a short pulse at 84 that might harm the patient as by breaking a rib, and which is such a short pulse that it creates no appreciable increase in blood circulation or breathing. With the wave spring, the bottom of the piston follows the path indicated at 86, which produces a more gradual reversal.

As mentioned above, a combined piston stroke of about four inches is desirable for full size adults, while a piston stroke of about two inches is desirable for a child or small adult. The emergency worker can rapidly decide the length of piston stroke that is appropriate for a particular patient. Applicant allows the emergency worker to quickly adjust the stroke length by providing at least one pair of stops 90, 92 (FIG. 1). Each stop includes a pin 94 that is mounted on a double click mechanism, of the type used in pens to project and retract the pen tip. When the emergency worker first pushes in the stop 90, the pin is latched (temporarily held) in the inward position wherein the pin lies in the path of the top flange 52 of the outer piston part Then the outer piston part cannot move down below the pin and the combined downward stroke length is about 2 inches (with the spring slowing the stroke near its bottom). Another pair of such stops can be provided at a lower location to allow only about one inch of outer piston part movement to limit the stoke length to three inches.

Figure 4:
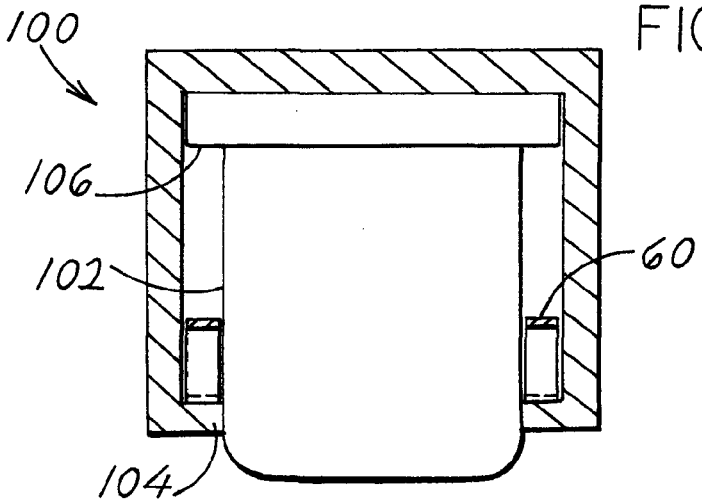
FIG. 4 is a sectional view of a chest compressor of another embodiment of the invention which includes only one piston part.

FIG. 4 shows a chest compressor actuator 100 with a single piston part 102. The wave spring 60 rests on an internal flange 104 of the actuator and is compressed by an external flange 106 of the piston part 102 of the actuator piston, only after about two-thirds of the total downward stroke.

Thus, the invention provides a chest compressor of the type in which a piston moves up and down (relative to a patient with an upwardly facing chest), wherein a spring is provided that engages the piston to slow its downward movement during a downward stroke, only after the piston has completed a majority of its downward stroke. The spring is preferably a compression spring, and is preferably a wave spring. The spring is useful for a chest compressor having a piston with only one piston part, or a piston with a plurality of telescoping piston parts. The downward stroke can be reduced from its maximum, by providing one or more stops that are moveable into the path of an outward flange of a piston or piston part, to prevent the piston or piston part from moving down along its full downward stroke.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A chest compressor for use by an emergency worker for applying compressions to the chest of a patient to enhance breathing and blood circulation, including:

a cylinder (12);

a piston (14) that is actuatable to move in the cylinder in a downstroke toward the patient and in an upstroke away from the patient;

said piston includes an outer piston part (40) and an inner piston part (42) that are engaged in a telescopic manner with one another with said outer piston part slidably engaged with and guided by said cylinder along a path and said inner piston part slidably engaged with and guided by said outer piston part; and, a spring (60) that engages said inner piston part to slow its downward movement and reduce its downward force only when said piston has completed at least two-thirds of its downstroke and helping to reverse piston movement to begin the upstroke.

2. The chest compressor described in claim 1, further including:

said inner piston part having an outward top flange (56);

said outer piston part having an inward bottom flange (54) lying below said inner piston part outward top flange; and, said spring is a wave spring that lies between said inner piston part outward top flange and said outer piston part inward bottom flange;

wherein said spring is compressed near the end of the piston downstroke.

3. The chest compressor described in claim 2, further including:

a stop (90) that is moveable from a nonlimiting location to a limiting location that lies in the path of said outer piston part, with the stop being latchable in said limiting location to reduce the length of downstroke movement of the outer piston part along each downstroke.

4. The chest compressor described in claim 3, further including:

said outer piston part having an axis (44) and an outwardly extending flange (52);

said stop comprises a pin (94) that is moveable radially inward toward said axis to said limiting location wherein said pin lies in the path of said outer piston part outwardly extending flange;

said pin being moveable outward to said nonlimiting location; and, said stop including a double click mechanism that latches said pin in said limiting location and releases said pin to said nonlimiting location.

5. The chest compressor described in claim 1 wherein:

said spring is a compression spring.

6. The chest compressor described in claim 5 wherein:

said compression spring slows and reverses movement of the piston along a height (H) of at least 20 millimeters; and, said compression spring being the only spring that applies a force to said piston.

7. The chest compressor described in claim 5 wherein:

said compression spring is a wave spring.

8. The chest compressor described in claim 7 wherein:

said wave spring has opposite sides, a horizontal width measured between said opposite sides, and a vertical height less than said horizontal width.

9. The chest compressor described in claim 5, further including:

an adhesive between said compression spring and said outer piston part bottom flange holding said compression spring on said outer piston part bottom flange.

10. The chest compressor described in claim 5, further including:

a hold down adjacent said outer piston part bottom flange holding said compression spring on said outer piston part bottom flange.

11. A method for repeatedly compressing the chest of a patient to stimulate blood circulation and breathing, the chest having resilience, comprising:

(a) providing a chest compressor for applying a single or a plurality of repeated compressions to said chest of said patient comprising:

a cylinder (12);

a piston (14) that is actuatable to move in the cylinder in a downstroke toward said patient to cause chest compression and in an upstroke away from said patient to allow chest resilience;

said piston comprising an outer piston part (40) and an inner piston part (42) that are engaged in a telescopic manner with one another with said outer piston part slidably engaged with and guided by said cylinder and said inner piston part slidably engaged with and guided by said outer piston part for the downstroke and the upstroke; and, a spring (60) that engages said inner piston part to slow its downward movement in the downstroke and reduce its downward force only when said inner piston part has completed at least two-thirds of its downstroke and helping to reverse piston movement to begin the upstroke;

(b) mounting said chest compressor on said chest of said patient;

(c) providing a compressed fluid and a control;

(d) repeatedly moving said piston from an upward position to a downward position against said chest of said patient by causing the compressed fluid to apply pressure to the piston to cause the downstroke and to allow the upstroke by releasing the pressure;

(e) said spring slowing the downward movement of said piston against said chest after said piston has completed at least two-thirds of its downstroke.

12. The method of claim 11, further including:

in further providing a stop (90) that is moveable from a nonlimiting location to a limiting location that lies in a path of said outer piston part to shorten its stroke; and, moving said stop to said limiting location to reduce the length of the downstroke movement of said outer piston part along each downstroke.

* * * * *